US005245804A

United States Patent [19]

Schiedegger et al.

[11] Patent Number: 5,245,804

[45] Date of Patent: Sep. 21, 1993

[54] VENT PIPE SHIELD

[75] Inventors: Charles E. Schiedegger, Metamora; Jeffrey E. Schiedegger, Lapeer, both of Mich.

[73] Assignee: Mid-America Building Products Corporation, Plymouth, Mich.

[21] Appl. No.: 928,129

[22] Filed: Aug. 11, 1992

[51] Int. Cl.[5] ..... E04D 13/08

[52] U.S. Cl. ..... 52/199; 52/105; 285/43

[58] Field of Search ..... 52/58, 105, 199; 285/42, 43, 44

[56] References Cited

U.S. PATENT DOCUMENTS

| | | | |
|---|---|---|---|
| 580,515 | 4/1897 | Weeden . | |
| 1,923,220 | 8/1933 | Lightbown . | |
| 3,163,101 | 12/1964 | Caparrelli . | |
| 3,436,880 | 4/1969 | Kifer . | |
| 3,797,181 | 3/1974 | Nievelt | 52/105 |
| 3,977,137 | 8/1976 | Patry . | |
| 4,010,578 | 3/1977 | Logsdon . | |
| 4,160,347 | 7/1979 | Logsdon . | |
| 4,265,058 | 5/1981 | Logsdon . | |
| 4,563,847 | 1/1986 | Hasty . | |
| 4,768,812 | 9/1988 | Katz . | |
| 4,897,974 | 2/1990 | Lane . | |
| 5,010,700 | 4/1991 | Blair . | |
| 5,018,748 | 5/1991 | Schalle . | |

FOREIGN PATENT DOCUMENTS

| | | | |
|---|---|---|---|
| 0990995 | 1/1983 | U.S.S.R. | 52/199 |

*Primary Examiner*—Carl D. Friedman
*Assistant Examiner*—Christopher T. Kent
*Attorney, Agent, or Firm*—Barnes, Kisselle, Raisch, Choate, Whittemore & Hulbert

[57] ABSTRACT

A roof vent pipe shield comprising an outer plastic cylinder and an inner plastic cylinder connected at one end by portions that are fusion bonded to one another such that there is a space between the cylinders. An outwardly flared portion extends from the other end of the outer cylinder for engagement with the roof. The flared portion terminates in a free edge lying in a plane which is at an angle to the axes of the cylinders. Indicia are provided on the inner surface of the flared portion to indicate the lines along which the flared portion should be cut to accommodate roofs of different pitch.

5 Claims, 2 Drawing Sheets

VENT PIPE SHIELD

This invention relates to roof vent pipe shields.

BACKGROUND AND SUMMARY OF THE INVENTION

It has heretofore been suggested that roof vent pipe shields be provided over a roof vent pipe. Such shields vary in type and can be of the type shown in U.S. Pat. Nos. 580,515, 3,163,101, 3,977,137, 4,010,578, 4,160,347, 4,265,058, 4,563,847, 4,768,812, 4,897,974, 5,018,748 and 5,010,700.

It has also been suggested that the roof vent pipe shields can be made with two tubular portions as shown for example in U.S. Pat. Nos. 1,923,220, and 3,446,880 and 3,797,181.

Among the objectives of the present invention are to provide a roof vent pipe shield which is more readily manufactured; which can stabilize the roof vent pipe; and which can be readily adapted to roofs of different pitch.

In accordance with the invention, a roof vent pipe shield comprising an outer plastic cylinder and an inner plastic cylinder connected at one end by portions that are fusion bonded to one another such that there is a space between the cylinders. An outwardly flared portion extends from the outer end of the outer cylinder for engagement with the roof. The flared portion terminates in a free edge lying in a plane which is at an angle to the axes of the cylinders. Indicia are provided on the inner surface of the flared portion to indicate the lines along which the flared portion should be cut to accommodate roofs of different pitch.

DESCRIPTION

Figure 1:
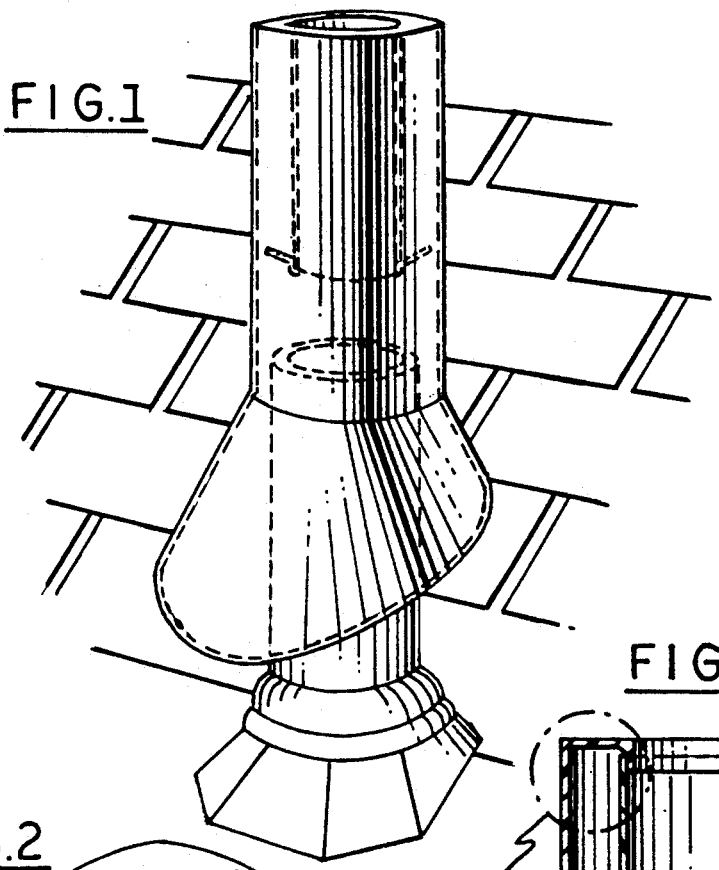
FIG. 1 is a fragmentary exploded perspective view of a roof vent pipe shield embodying the invention being applied over a roof vent pipe with a seal.
Figure 2:
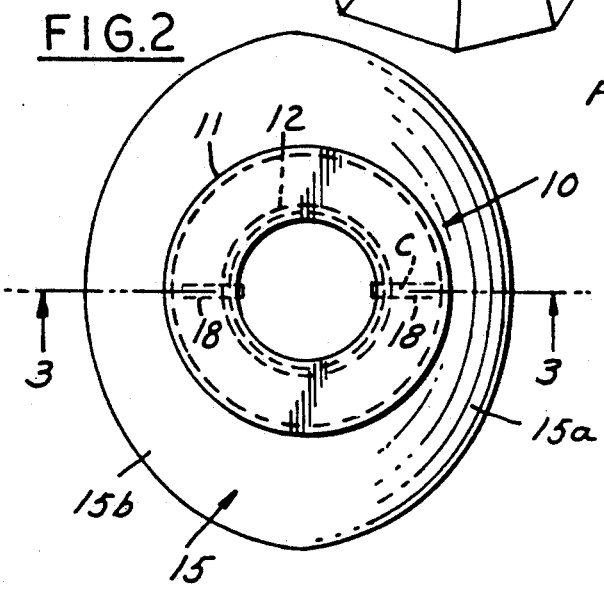
FIG. 2 is a plan view of the roof vent pipe.
Figure 4:
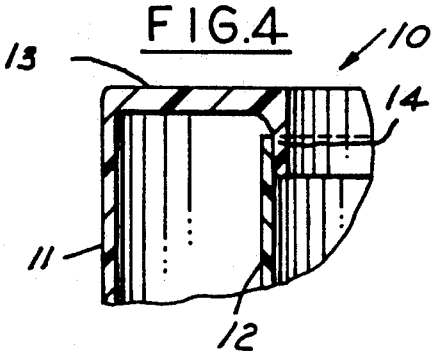
FIG. 4 is a sectional view on an enlarged scale taken at the circle of FIG. 4 in FIG. 3.

Referring to FIG. 1, the roof vent pipe shield 10 embodying the invention is adapted to be applied over a roof vent pipe P on a roof R which extends through a seal S, the latter being any well known type of seal such as disclosed and well known in the art.

The roof vent pipe shield 10 comprises an outer plastic cylinder 11 and an inner plastic cylinder 12 telescoped within the outer cylinder 11. The upper ends of the cylinders 11, 12 are joined by fusion bonding in an arrangement wherein the outer cylinder 11 has a radial flange 13 extending inwardly and an axial flange 14. The inner cylinder 12 has its upper end telescoped over the flange 14 and fusion welded to the axial flange 14 as by spinning. By this arrangement, the manufacture of the shield is facilitated and does not require complex molding.

Figure 3:
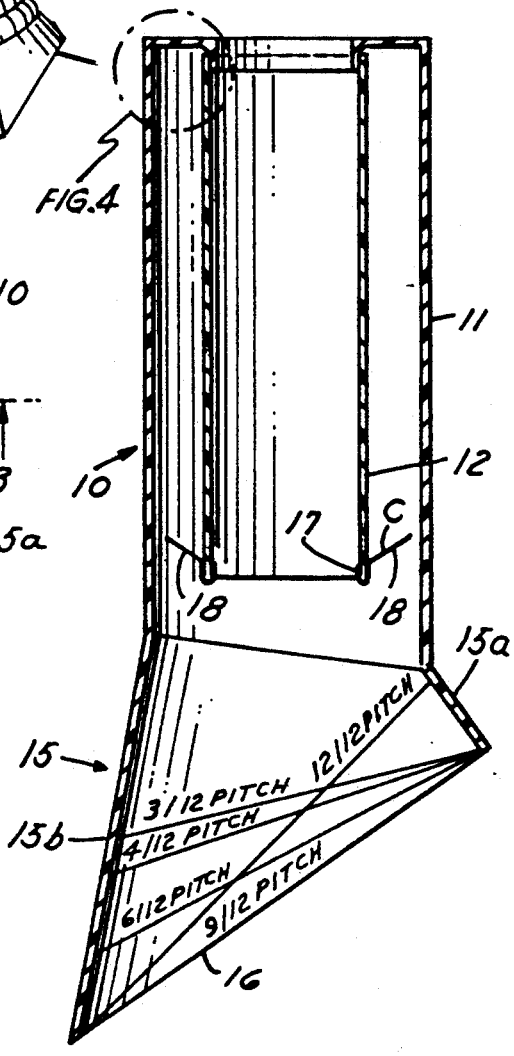
FIG. 3 is a sectional view taken along the line 3—3 in FIG. 2.
Figure 5:
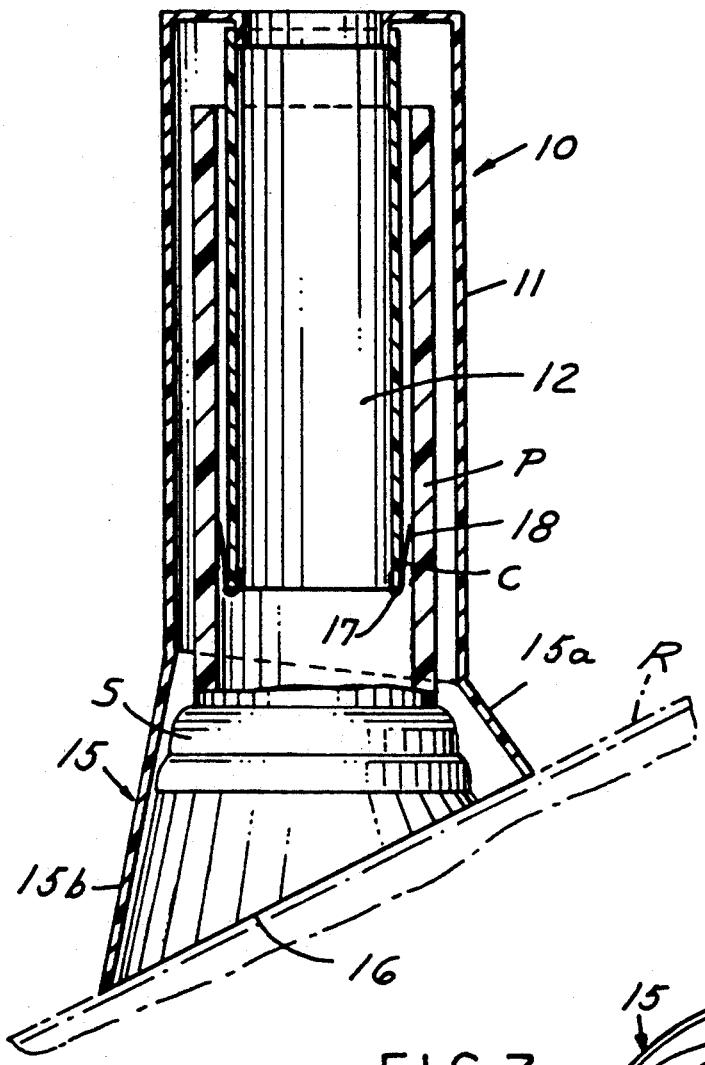
FIG. 5 is a sectional view showing the roof vent pipe shield applied to a vent pipe on a roof.
Figure 6:
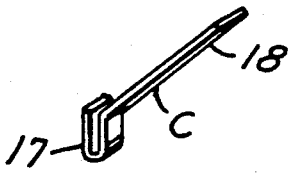
FIG. 6 is a perspective view of a spring clip utilized in connection with the roof vent pipe shield.

The shield 10 further includes a lowered flared portion 15 at its other end that extends outwardly to a free edge 16 that lies in a single plane. The plane is at an angle to the axis of the cylinders so that the wall of the flared portion progressively changes from a short height 15*a* to a long height 15*b*. A plurality of removable circumferentially spaced clips C (FIG. 6) are provided and include a U-shaped portion 17 that telescopes over the free lower edge of the cylinder 12 and a flared spring portion 18 that extends upwardly and outwardly as shown in FIG. 3, clips C resiliently engage the inner surface of the pipe P (FIG. 5).

Figure 7:
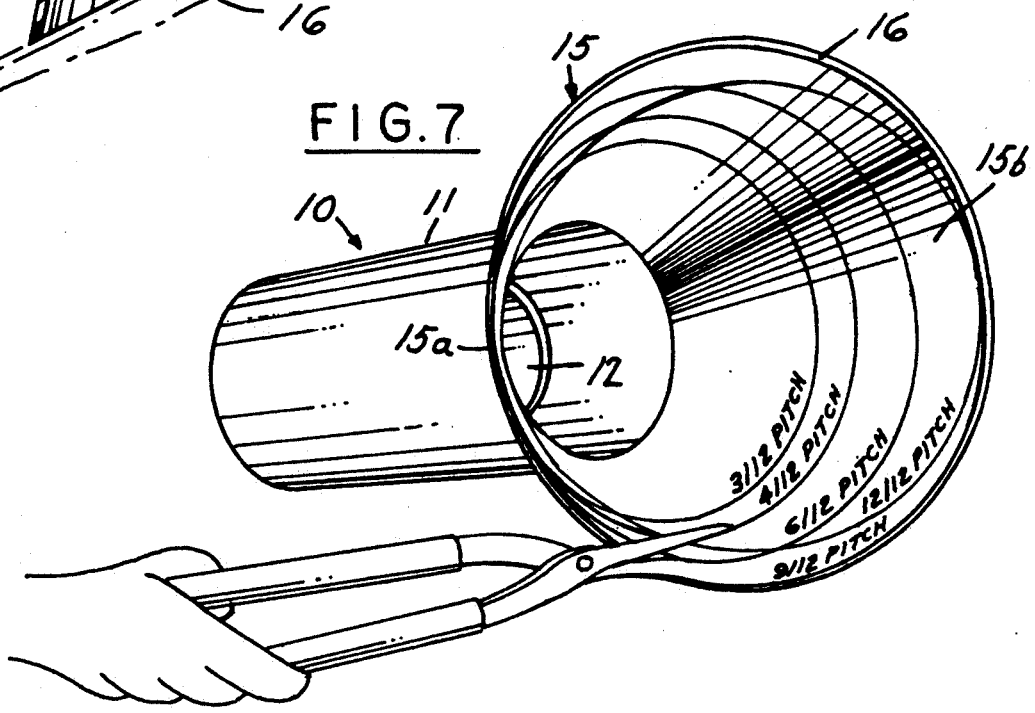
FIG. 7 is a perspective view showing the cutting of the roof vent pipe shield to accommodate roofs of different pitch.

In accordance with the invention, the inner surface of the flared portion 15 is provided with indicia in the form, preferably, of raised or embossed lettering and lines. This indicia is intended to provide guidance in cutting the flared portion to accommodate roofs of different pitch (FIG. 7). Specifically, the free edge is marked with the designation 9/12 PITCH, a second line is marked with the designation 12/12 PITCH and additional lines are marked with the designation 3/13 PITCH; 4/12 PITCH and 6/12 PITCH.

In order to fully accommodate and maximize the use of material, the indicia 12/12 PITCH in associated lines intersect the lines 3/12 PITCH, 4/12 PITCH, 6/12 PITCH that emanate from the lower edge of the short portion 15*a* while the 12/12 PITCH line emanates from the free edge of the portion 15*b*.

It can thus be seen that there has been provided a roof vent pipe shield which is more readily manufactured; which can stabilize the roof vent pipe; and which can be readily adapted to roofs of different pitch.

We claim:

1. A roof vent pipe shield comprising
an outer plastic cylinder,
an inner plastic cylinder,
each of said cylinders having an upper end portion, a remote end portion and longitudinal axes,
an integral outwardly flared portion extending from said remote end portion of the outer cylinder for engagement with a roof,
said flared portion terminating in a free edge lying in a plane which is at an angle to the axes of the cylinder,
said outer cylinder and said inner cylinder being fusion bonded at said upper end portion such that there is a space between the cylinders,
said fusion bonding of the outer cylinder and inner cylinder being obtained by an integral radial flange on the upper end portion of the outer cylinder and an integral axial flange extending inwardly of said outer cylinder from the radial flange, said inner cylinder being in telescoping relation to the axial flange at the upper end portion and spin welded thereto.

2. The roof vent pipe shield set forth in claim 1 wherein the free edge of the flared portion is oval and includes a short portion that progressively extends to an opposite long portion.

3. The roof vent pipe shield set forth in claim 1 including removable spring clips from the remote end portion of the inner cylinder for applying a yielding force to a roof pipe extending upwardly between the said inner and outer cylinders.

4. The roof vent pipe shield set forth in any one of claims 1–3 including indicia on the flared portion defining lines along which the flared portion should be cut to adapt the roof vent pipe shield to roofs having different pitches.

5. The roof vent pipe shield set forth in claim 4 wherein said indicia includes lines emanating from the free edge of the short portion and progressively decreasing in pitch from the free edge and a line of maximum pitch emanating from the free edge of the long portion and crossing the aforementioned lines.

* * * * *